United States Patent [19]

Lyons, Sr.

[11] Patent Number: 4,688,768

[45] Date of Patent: Aug. 25, 1987

[54] EXTENDABLE RAILING

[75] Inventor: Robert J. Lyons, Sr., Hamden, Conn.

[73] Assignee: The Bilco Company, New Haven, Conn.

[21] Appl. No.: 851,739

[22] Filed: Apr. 14, 1986

[51] Int. Cl.[4] ..... E04H 17/14

[52] U.S. Cl. ..... 256/59; 182/106; 403/109

[58] Field of Search ..... 403/109, 107; 182/106, 182/81; 256/59

[56] References Cited

U.S. PATENT DOCUMENTS 3,154,325 10/1964 Thompson et al. ..... 403/107 X 3,463,457 8/1969 Alexander ..... 256/59

4,546,855 10/1985 Lyons ..... 182/106

*Primary Examiner*—Andrew V. Kundrat

*Attorney, Agent, or Firm*—DeLio & Associates

[57] ABSTRACT

An extendable railing for use in stairwells, hallways and the like. The railing comprises an elongated moveable member nonrotatably but slidably mounted inside an elongated fixed, hollow member. The moveable member is supported on at least one friction reducing spacing means for movement from a first retracted to a second extended position with counterbalance means. The railing further comprises means for stopping said movement and for locking said moveable member in the extended position.

11 Claims, 6 Drawing Figures

EXTENDABLE RAILING

FIELD OF THE INVENTION

The present invention relates to hand railings for use in stairwells, hallways and the like, and more particularly, extendable railings.

BACKGROUND OF THE INVENTION

In the construction of many buildings, one approach to providing access to the basement areas thereof is to build one or more stairwells into the foundation walls, each containing a flight of steps usually leading to the outside. To provide building security and to keep the stairwell clean, it is a common practice to close off the openings to the outside with a hatch containing one or more access doors. To provide for proper drainage and headroom clearance, the rear end of the hatch is usually raised some distance above the outside grade. The doors of the hatch may also contain handles, locks, latches, windows and other features to fit the particular needs of the project in which they are used. Many designs for such hatches exist, and they are readily available.

One difficulty with these hatch designs is that, for aesthetic, mechanical or other considerations, it is difficult to install safety devices, such as hand railings and the like. If such a hand rail is installed in a stairwell, it cannot extend very far beyond the top of the stairwell since it will interfere with the door closure. Because of this, when the standard hand rail is employed, it usually does not extend far enough to allow a person ascending the steps to hold onto the hand rail until the safety of the upper horizontal landing or grade is reached. Similarly, a person descending the steps would have to come partway down the stairwell unaided by the railing before being able to grasp the hand rail.

SUMMARY OF THE INVENTION

In the present invention, providing hand rail support for a person using the stairs in a stairwell is achieved with an extendable hand rail of novel design. Accordingly, the railing of the present invention comprises a fixed, hollow elongated member and a nonrotatable, but slidably moveable member mounted within. The latter is adapted to be pulled out from the fixed member from a first retracted position to a second extended position, so that one needing to use the railing for support, could have the use of the same (for the full length of the stair) as compared to the railings of the prior art. The present invention further utilizes means to reduce friction and optional counterbalance means to facilitate movement of the moveable member from the retracted to the extended position. Stop means to prevent inadvertent removal of the moveable member from the fixed member and latch means to hold the moveable member in the extended position are also utilized.

The invention accordingly comprises a product possessing the features, properties, and a relation of components which will be exemplified in the product hereinafter described and the scope of the invention will be indicated in the claims.

OBJECTS OF THE INVENTION

It is an object of the present invention to provide a new extendable hand rail for use in stairwells, hallways and the like.

It is a further object of the present invention to provide a new extendable hand rail which may be utilized in a first retracted position and a second extended position.

It is still another object of the present invention to provide a new extendable hand rail wherein said moveable member can be locked in position when it is in the extended position.

Still other objects, features and advantages of the present invention will be, in part, obvious and, in part, apparent from the specification. For a fuller understanding of the invention, reference is made to the following description taken in connection with the accompanying drawings.

DETAILED DESCRIPTION OF THE INVENTION

Figure 1:
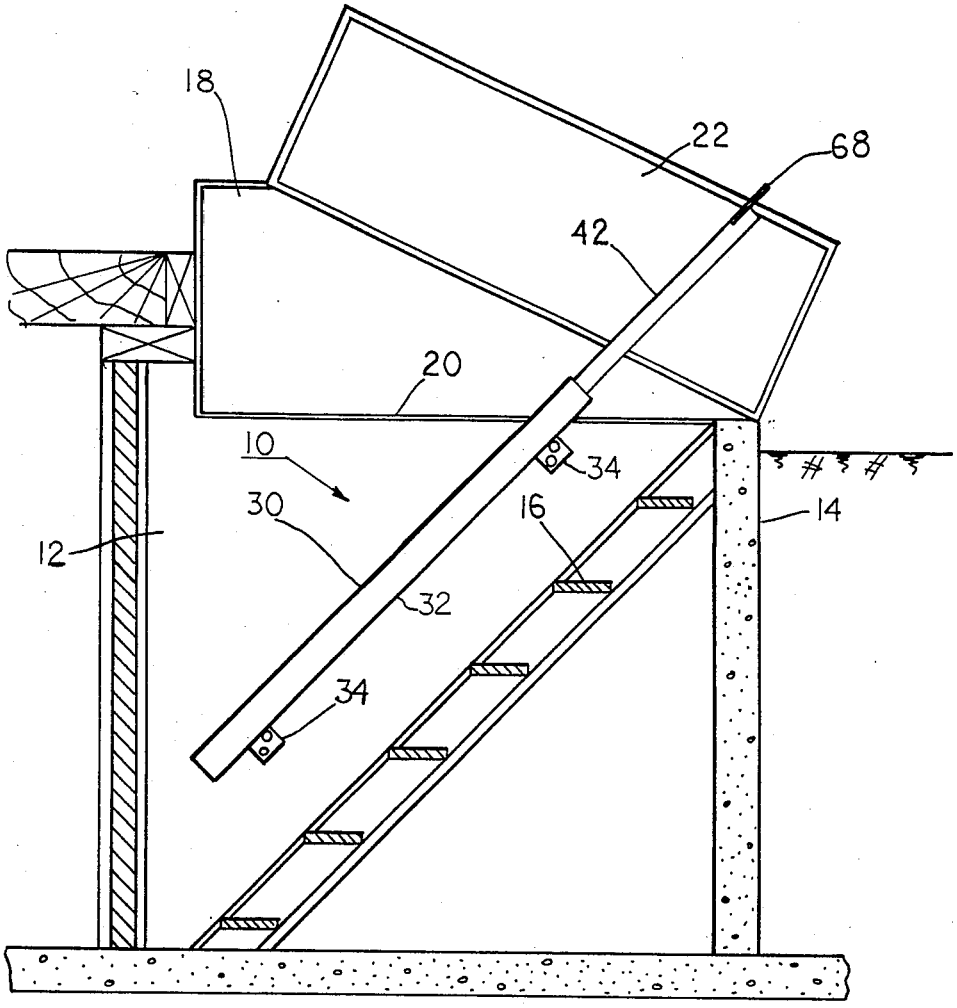
FIG. 1 is a side view partially in section 1 showing an exemplary stairwell and railing arrangement with the railing of the instant invention shown in the extended position.

Referring to FIG. 1, an exemplary basement stairwell is generally identified as 10, having sidewalls 12, a frontwall 14, and a plurality of steps 16, which may be built into the foundation of a building. On top of stairwell 10 is a hatch 18 having a base 20 and at least one door 22. Normally, hatch 18 completely covers the opening over the stairwell. An extendable railing 30 according to the present invention is shown attached to one of side walls 12 with the railing being in the extended position.

Figure 6:
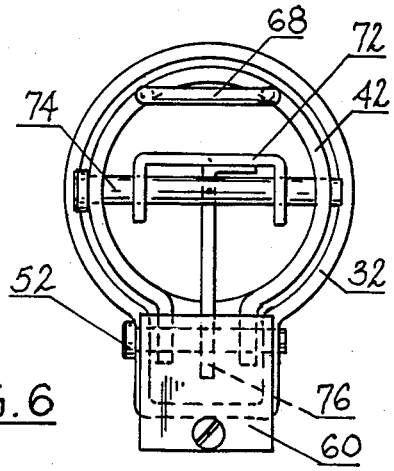
FIG. 6 is an end view of a second embodiment of the extendable railing of FIG. 1.
Figure 2:
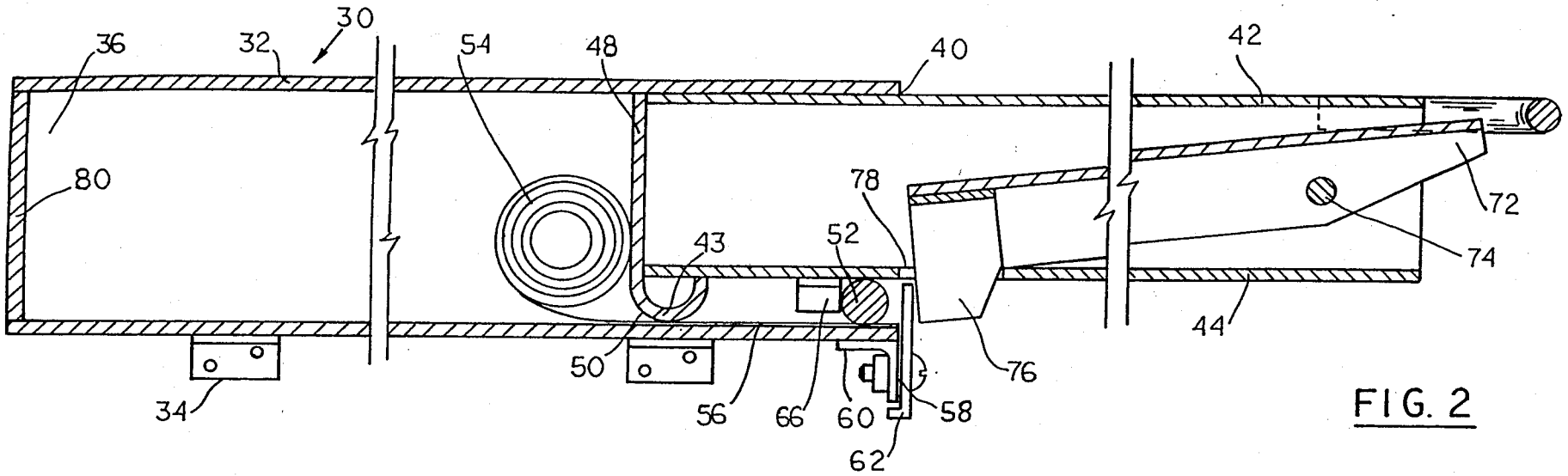
FIG. 2 is a cross sectional view of a portion of the extendable railing shown in FIG. 1.
Figure 5:
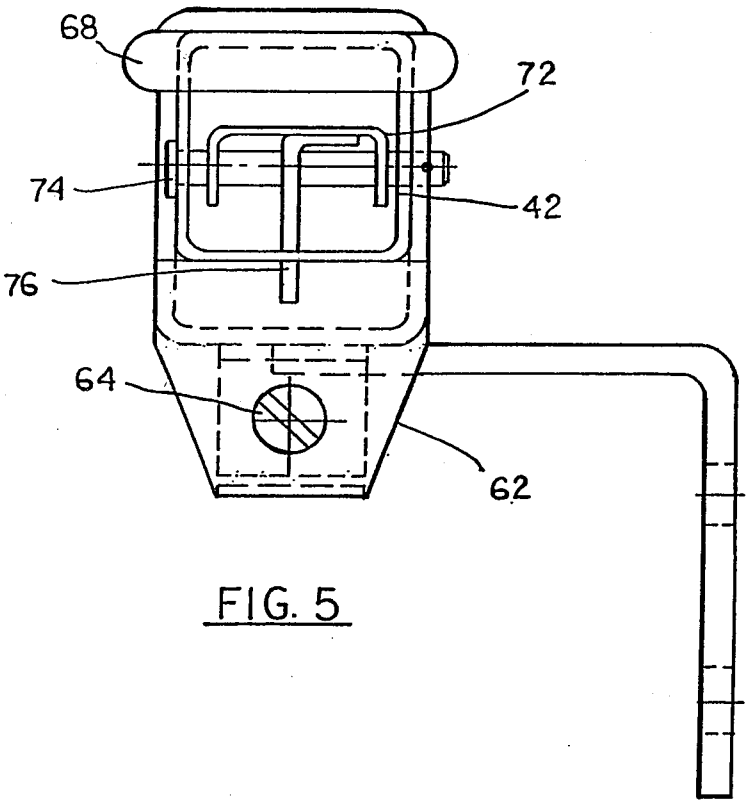
FIG. 5 is an end view of the railing of FIG. 2 as seen from the higher end of FIG. 1.
Figure 4:
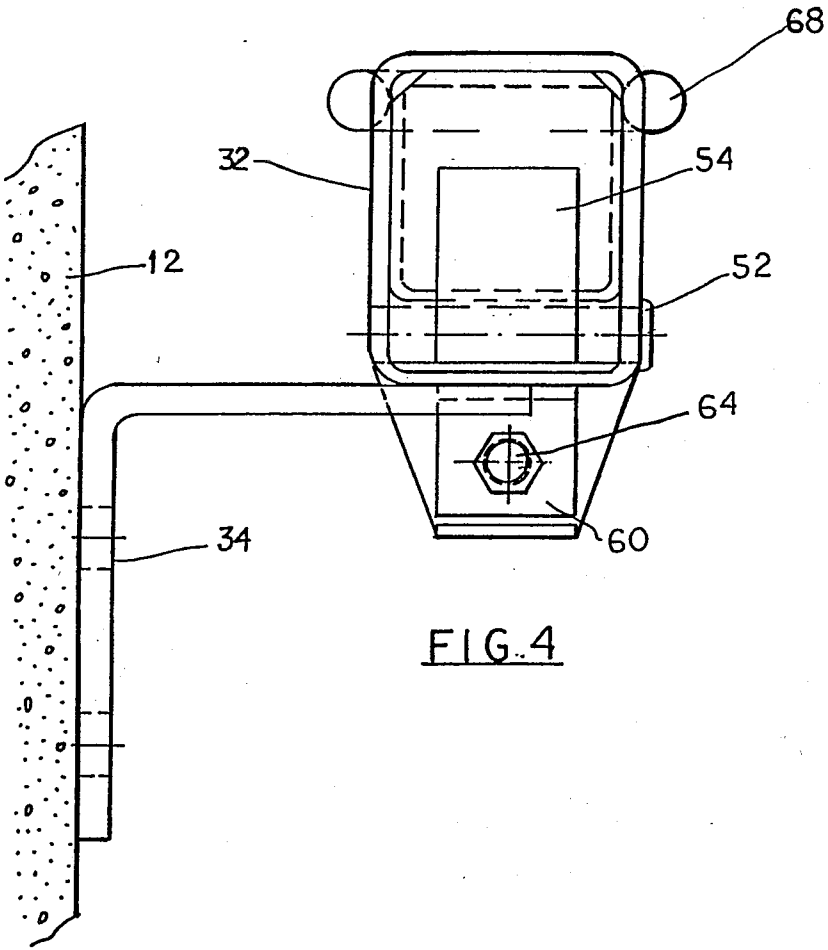
FIG. 4 is an end view of the railings of FIG. 2 as seen from the lower end of FIG. 1.

Referring to FIGS. 2 and 5, extendable railing 30 comprises an elongated, hollow member 32 which is fixedly attached to side wall 12 by brackets 34. In a typical installation, rear end 36 will be placed, at a convenient height above the lowest of steps 16 and pointed upwardly at an angle more or less equal to the pitch of flight of stairs. Front end 40 is normally positioned substantially even with the top of side wall 12 as close as possible to hatch 18, without interfering with its closure. Projectable upwardly and outwardly from the front end 40 is an elongated, moveable member 42 which, while adapted to slide freely within fixed member 32 is restricted, in any suitable manner, so as to be nonrotatable therein. Nonrotation is preferably achieved by having the internal periphery of fixed member 32 and the external periphery of moveable member 42 both in noncircular form. In the preferred embodiments of the present invention, as shown in FIGS. 4 and 5, the two members are of rectangular shape, with the external dimensions of moveable member 42 being smaller than the interior width of fixed member 32. Both members are, preferably, made of metal and particularly steel so that in the extended position, no additional support is required for the moveable member. In is understood that other geometric configurations, such as ovals, triangles, or polygons could be substituted for the rectangles shown in FIG. 2, without affecting the basic functions of the two members. In another embodiment, the members 32 and 42 are circular in shape with a rectangular, square or circular appendage attached to prevent rotation as shown in FIG. 6.

In the extendable railing of the present invention, sliding friction is reduced by utilizing one or more spacing means such as 43 attached to bottom surface 44. Such spacing means create an open, noncontacting area underneath moveable member 42 so that frictional sliding resistance is largely eliminated. By so doing, moveable member 42 is both supported and braced so as to create a smooth transition from the retracted to the extended position.

In a preferred embodiment, the end of moveable member 42 is provided with an end cap 48 having a curved bottom portion 50 thereon. To prevent cocking of moveable member 42 within member 32 one or more additional spacing lugs 43 can be placed at intermediate locations on bottom surface 44 to keep moveable member 42 level. In the preferred embodiment, such leveling is accomplished by placing a fixed or rotatable pin 52 across the width of member 32 at front end 40, so that moveable member 42 can rest thereon and slide easily thereover. It is understood that curved bottom 50 may be replaced or supplemented by rollers, bearings or other devices adapted to further lower frictional resistance.

An even further reduction of the force required to move member 42 to the extended position can be achieved by incorporating means for counterbalancing its weight. One such device is a resilient coil spring 54, the body of which is mounted on the outer side of end cap 48 so that it can be unwound to produce an elongated strip 56. In the embodiment of FIG. 2, strip 56 extends under the length of moveable member 42 with its endmost portion 58 being clamped at front end 40 to fixed member 32. This is done with downwardly disposed spring clip 60 over which end portion 58 is bent. Completing the assembly is spring clamp 62 with the combination being held together by bolt assembly 64. As shown in FIG. 2, clamp 62 is designed with an extended upper portion which can replace pin 52 for supporting member 42 within member 32.

Spring 54 is installed so that it is more or less fully wound up when moveable member 42 is in the extended position and unwound when moveable member 42 is retracted. When moveable member 42 is then moved to the extended position, the spring 54 rewinds and forceably bears against end cap 48. This effectively decrease the external force needed to move member 42. To avoid having strip 56 pass over a sharp edge at the back end of moveable member 42, it is normally passed under rounded end cap bottom portion 50 so that end cap 48 actually slides on strip 56 instead of the interior surface of fixed member 32.

Coil springs of the type herein above described are known as "negator" springs. These can be obtained commercially with a wide range of preset unwinding forces. In the present invention, this force is selected to be just slightly less than the weight of moveable member 42. In so doing, the magnitude of the externally applied force needed to extend the railing is greatly reduced, but not entirely eliminated. This is done to prevent a user from being injured after hatch door 22 has been opened by moveable member 42 spontaneously extending itself. It is understood that other types of counterbalance construction are available and may be used to accomplish such force reduction in the present invention.

Limiting the outwardly directed travel of moveable member 42 and preventing its complete removal from fixed member 32 is stop lug 66. This is sized and positioned to abut and firmly engage either pin 52 or, optionally, the upper extension of spring clamp 62 when moveable member 42 has reached the extended position. Stop lug 66 can either be a separate nonsliding lug, as shown in FIG. 2, or the most forward of any additional intermediate spacing lugs 43 which may be used. Whichever approach is adopted, stop lug 66 should be positioned so that when moveable member 42 has been "fully" extended, some length will still be retained and supported within the confines of member 32 to minimize the possibility of a heavy vertical load on the outer end of member 42 causing bending or cocking thereof.

Figure 3:
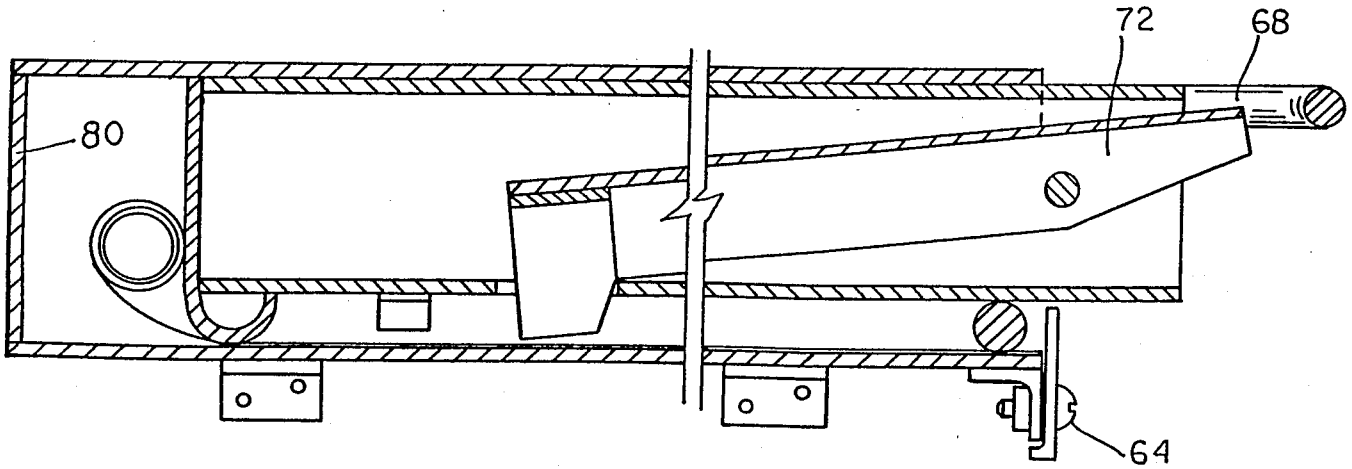
FIG. 3 is a cross sectional view of a portion of the railing of FIG. 1 showing the railing in the retracted position.

As shown in FIG. 1, handle 68 is attached to the outer end of moveable member 42. In a preferred embodiment, the handle is U-shaped and is welded or otherwise attached thereto. As shown most clearly in FIGS. 4 and 5, the handle is designed so that it is wider than the hollow interior of fixed member 32. Thus, when member 42 is fully retracted, handle 68 is blocked by front end 40 so that further inward movement is stopped. As shown in FIG. 3, this occurs before coil spring 54 has exited from rear end 36. This helps to keep the spring clean and to protect it from inadvertent damage in service. Further protection can be achieved by closing off rear end 36 with a plate or similar device 80. This will both prevent foreign objects from being inserted into fixed member 32 and restrain moveable member 42 from falling out, in the event handle 68 fails in service.

Retraction of member 42, when in the extended position, is prevented by a latch pivotly mounted within moveable member 42. As shown in FIGS. 2 and 3, the latch comprises elongated channel 72 mounted within moveable member 42 by pivot 74 and a strike plate 76, which is mounted perpendicular to channel 72 at its inner end. This, in turn, projects through an appropriately placed aperature 78 in bottom surface 44. When member 42 has been fully extended, latching will occur by the strike plate rotating downward through aperature 78 just in front of spring clamp 62 or, optionally, pin 52. Upon release of handle 68, any retromotion of moveable member 42 will cause the rearmost edge of plate 76 to make firm contact therewith and positively lock the railing in place.

Unlatching moveable member 42 for retraction is achieved by depressing the outermost end of channel 72 around pivot 74. This will cause strike plate 76 to rotate back into the interior of member 42. By so doing, member 42 is released for movement back into the retracted position. It is understood that other types of latching mechanisms may be substituted for that shown without affecting the basic functioning of the assembled railing structure.

It will thus be seen that the objects set forth above, among those made apparent from the preceding description are, sufficiently attained and, since certain changes may be made in the above product without departing from the spirit and scope of the invention, it is intended that all matter contained in the above description and shown in the accompanying drawing shall be interpreted as illustrative and not in a limiting sense.

It is also understood that the following claims are intended to cover all of the generic and specific features of the invention herein described, and all statements of the scope of invention which, as a matter of language, might be said to fall there between.

I claim:

1. An extendable railing for attachment to a wall, comprising:

a fixed hollow elongated member;

a moveable elongated member nonrotatably slideable within said fixed member, said moveable member having a front end and a rear end;

spacing means mounted on said moveable member to facilitate sliding movement of said member within said fixed member;

means for limiting the movement of said moveable member to retracted and extended positions;

latch means for holding said moveable member in said extended position, said latch means having actuator means operable from the front end of the moveable member to unlatch the extended railing and permit retraction; and counterbalance means for facilitating movement of said moveable member from the retracted to the extended position.

2. The extendable railing of claim 1 wherein said spacing means comprises a lug attached to the rear end of said moveable member and at least one additional lug attached to an intermediate portion of said moveable member.

3. The extendable railing of claim 1 wherein said limiting means comprises a stop positioned at one end of said fixed member and adapted to engage one of said lugs to prevent removal of said moveable member from said fixed member when in the extended position.

4. The extendable railing of claim 3 wherein said stop is a pin mounted across the end of said fixed member.

5. The extendable railing of claim 3 wherein said stop is a plate mounted across the end of said fixed member.

6. The extendable railing of claim 3 wherein said limiting means further comprises means for preventing removal of said moveable member from said fixed member when in a retracted position.

7. The extendable railing of claim 6 wherein said means for preventing removal comprises a lifting lug mounted onto the front end of said moveable member so as to engage the upper endmost portion of said fixed member and halt further inward movement of said moveable member when it is moved to the retracted position.

8. The extendable railing of claim 1 wherein said latch means comprises a pivotable lever attached to said moveable member which is adapted to lock said moveable member in an extended position, relative to said fixed member.

9. The extendable railing of claim 1 wherein said counterbalance means is a coil spring engaging the rear end of said moveable member, one end of said counterbalance means being attached at the upper end of said fixed member so that retraction of said moveable member will cause said coil spring to unwind and extension of said moveable member will cause said coil spring to rewind, said rewinding acting to cause said spring to bear upon said rear end so as to counterbalance substantially all of the weight of said moveable member.

10. The extendable railing of claim 1 wherein said fixed and moveable members are rectangular in shape.

11. The extendable railing of claim 1 wherein said moveable member is square in shape.

* * * * *